US006972655B2

(12) United States Patent
Tobias

(10) Patent No.: US 6,972,655 B2
(45) Date of Patent: Dec. 6, 2005

(54) CONSTRUCTION FOR COOLED SOLENOID

(75) Inventor: Lee A. Tobias, Laguna Niguel, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 182 days.

(21) Appl. No.: 10/633,474

(22) Filed: Aug. 4, 2003

(65) Prior Publication Data

US 2005/0030134 A1 Feb. 10, 2005

(51) Int. Cl.[7] ..... H01F 27/08
(52) U.S. Cl. ..... 336/55; 336/57
(58) Field of Search ..... 336/55, 57, 58, 336/61, 62, 94; 60/508, 515, 912

(56) References Cited

U.S. PATENT DOCUMENTS 3,956,724 A 5/1976 Fagan, Jr. et al.
4,692,560 A 9/1987 Hotta et al.
4,783,634 A 11/1988 Yamamoto et al.
4,786,886 A 11/1988 Tada et al.
4,808,954 A 2/1989 Ito
4,861,149 A * 8/1989 Ealey ..... 359/849
5,365,211 A 11/1994 Carbaugh, Jr.
5,598,137 A 1/1997 Alber et al.
5,936,502 A 8/1999 England et al.
6,354,253 B1 * 3/2002 Katsumata et al. ..... 123/90.11

* cited by examiner

*Primary Examiner*—Anh Mai
(74) *Attorney, Agent, or Firm*—Mark A. Wurm

(57) ABSTRACT

An electromagnetic, liquid or gas cooled solenoid coil is constructed of an inner core formed by a simulated pole piece. The inner core has coolant feed ports that communicate with a surrounding perforated bobbin. A pair of ordinary electromagnetic wires is twisted around each other to form a helix, and the helix is wrapped around the perforated bobbin. Liquid or gas coolant is introduced into an opening in the core, flows through the ports into the bobbin, and then flows radially through the coil from the inside diameter of the coil to the outside diameter of the coil, thereby removing heat from the self-heating coil wire. In alternative embodiments, a supply manifold and receiver manifold are integrated into the solenoid coil.

20 Claims, 5 Drawing Sheets

CONSTRUCTION FOR COOLED SOLENOID

FIELD OF THE INVENTION

The present invention relates to electromagnetic solenoid coils, and in particular, cooling systems for such coils.

BACKGROUND OF THE INVENTION

Electromagnetic solenoid coils self-heat due to resistive losses in their windings. This heating limits the endurance and power density capability of such coils. Cooling of these coils is normally provided by free convection and radiation to their surroundings. However, such convective and radiated cooling is a relatively slow heat transfer process at the normal operating temperatures for solenoid coils.

Consequently, there is a need in the art of electromagnetic solenoid coils for a non-passive cooling system to offset the resistive heating of solenoid coils. The present invention satisfies that need.

SUMMARY OF THE INVENTION

An electromagnetic solenoid coil has an inner core through which a liquid or gas coolant flows. The coolant enters the inner core through an opening in the bottom of the core. The body of the inner core is in communication with a surrounding perforated bobbin. A pair of ordinary electromagnetic coil wires is wound around each other to form a helix, and the helix is then wrapped around the perforated bobbin. A coolant flows into the inner core through the opening, and then to the duplex wound coil wires by way of the perforated bobbin. The duplex wound coil wires provide a connected porosity within the coil that permits the coolant to flow in a radial fashion through the coil from the coil's inside diameter to its outside diameter. In alternative embodiments, a supply manifold and a receiver manifold are integrated into the solenoid.

It is consequently an object of the present invention to provide an electromagnetic solenoid coil that can be cooled with liquid or gas coolant.

DETAILED DESCRIPTION OF THE INVENTION

Figure 1:
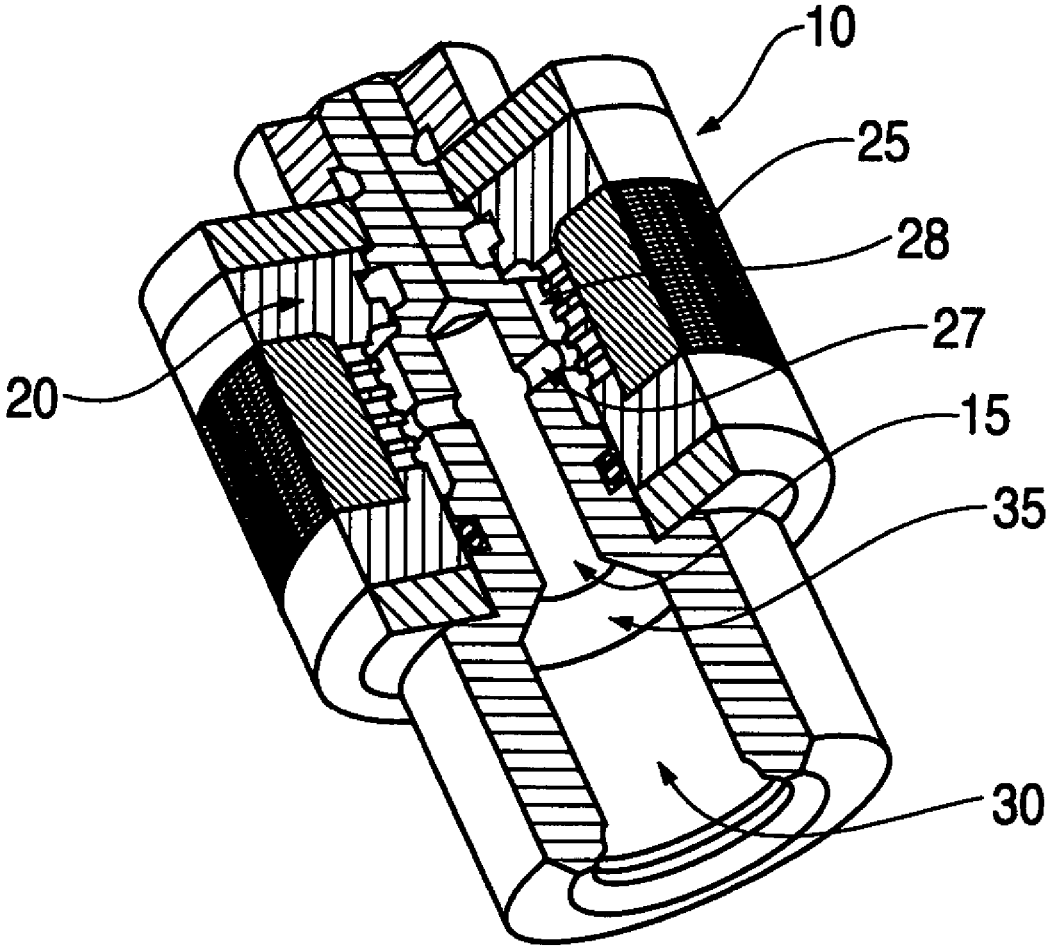
FIG. 1 is an illustration of the liquid or gas cooled electromagnetic solenoid coil of the present invention.

An electromagnetic solenoid 10 of the present invention is illustrated in FIG. 1. The solenoid 10 has a simulated pole piece 35 that forms an inner core 15. The core 15 has opening 30 through which coolant enters the solenoid. Surrounding inner core 15 is perforated bobbin 20 and duplex wound solenoid coil wires 25. Coil wires 25 are shown in greater detail in FIG. 4. Pole piece 35 and bobbin

20 are cross drilled so that the resulting ports 27 and 28 provide a radial means of communication from the inside diameter of the coil to the outside diameter of the coil. Ports 27 and 28 allow simulated pole piece 35 to communicate with the perforated bobbin 20. Perforated bobbin 20 in turn communicates with the duplex wound solenoid coil 25.

Figure 2:
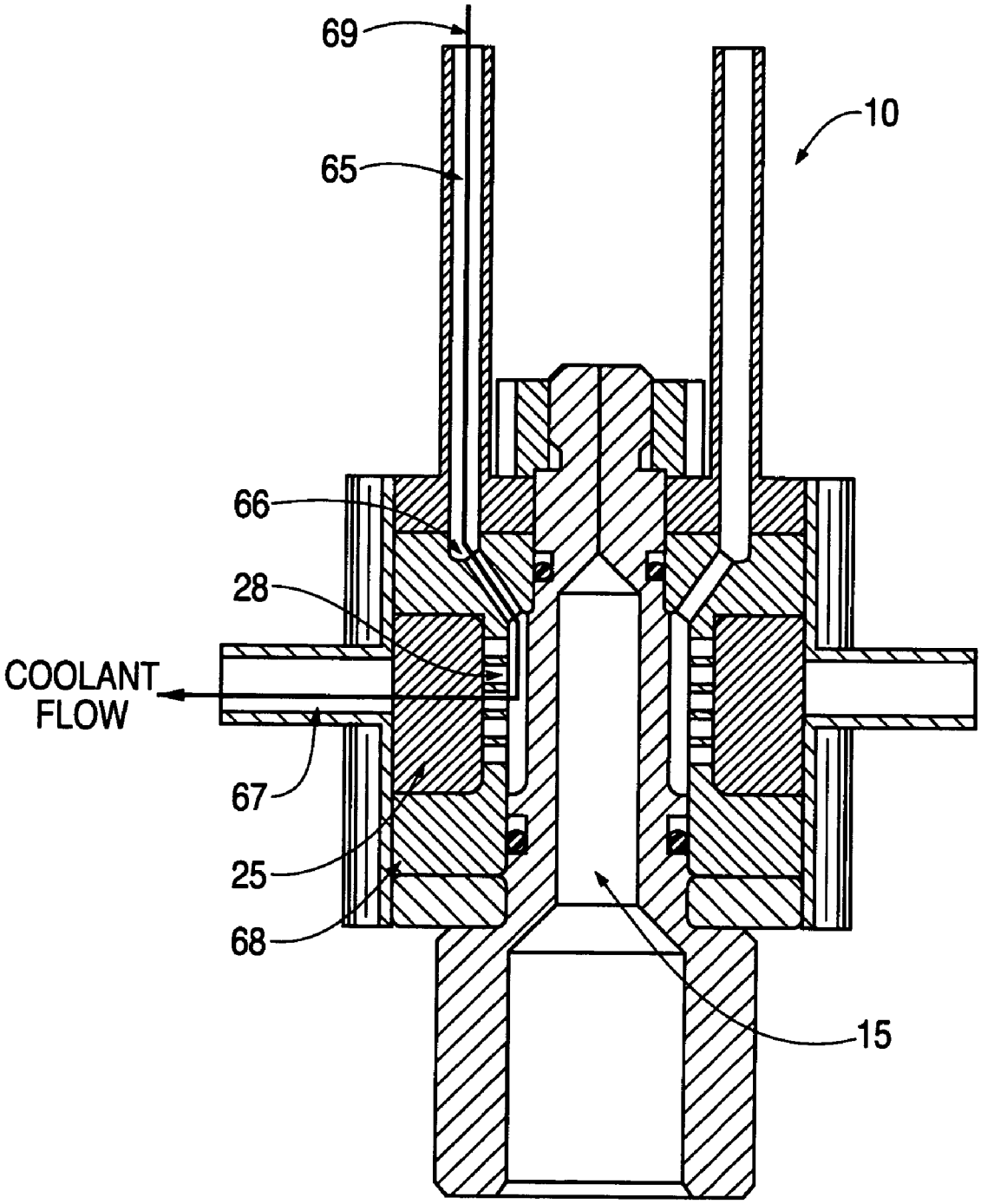
FIG. 2 is an illustration of a second embodiment of the liquid or gas cooled electromagnetic solenoid coil of the present invention fitted with supply and receiver manifolds.
Figure 3:
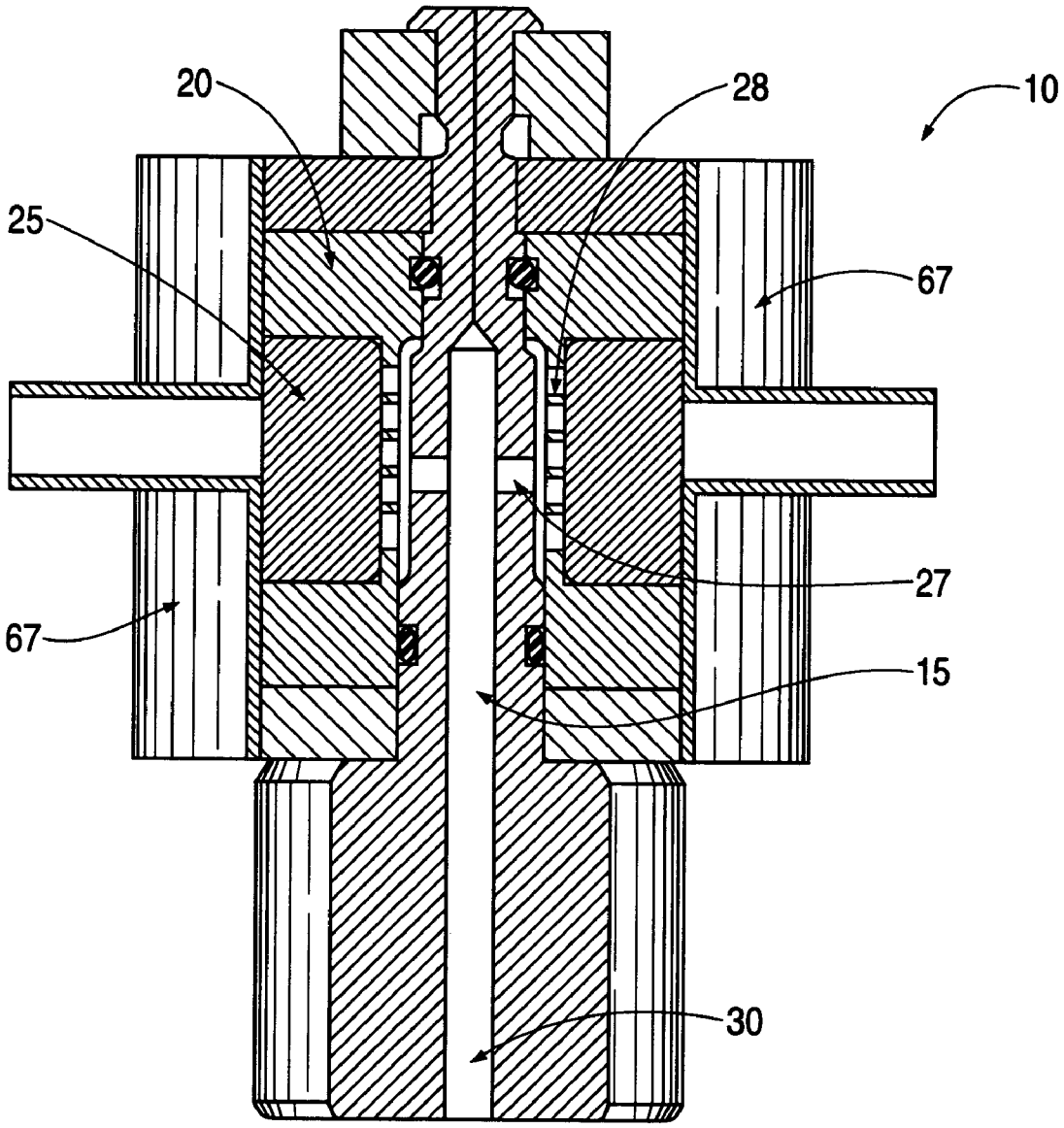
FIG. 3 is an illustration of a third embodiment of the liquid or gas cooled electromagnetic solenoid coil of the present invention fitted with a receiver manifold.

An alternative construction places a supply manifold 65 on the solenoid 10 as illustrated in FIG. 2. Supply manifold 65 is in communication with plenum 66 which in turn connects with the inner core 15. FIG. 2 further illustrates a receiver manifold 67 that is positioned on the solenoid 10. Plenum 68 is formed between the receiver manifold 67 and the solenoid coil wires 25. Another alternative construction uses the receiver manifold 67 without the supply manifold. This embodiment is shown in FIG. 3.

Figure 4:
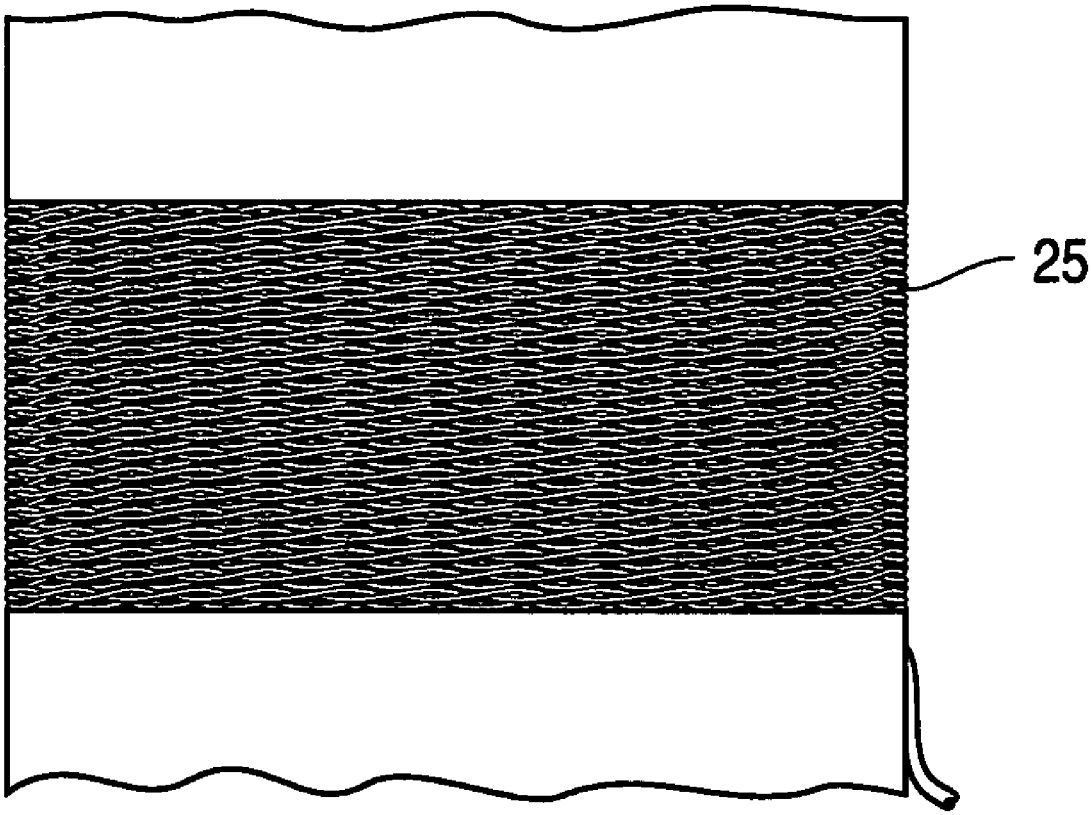
FIG. 4 is an illustration of a duplex wound solenoid coil wire of the present invention.

FIG. 4 illustrates in more detail wire 25 which makes up the coil. In a preferred embodiment, wire 25 is duplex wound, which provides connected porosity throughout the thickness of the coil. That is, the air space formed by the duplex wound coil wire connects the inner diameter of the coil with the outer diameter of the coil. In alternative embodiments, three or more wires may be wound around each other to form the coil wire. In these alternative embodiments, the shape of the perimeter of the wound wires approaches a circle as more and more wires are wound. That is, three wires wound around each other approximate a triangle, four wires wound around each other approximate a square, five wires approximate a pentagon, and so on. As the outside perimeter of the wound coil wire approaches a circle, more and more wire is replacing the dead air space provided by wires wound of lesser numbers. Consequently a duplex wound wire provides the most dead air space, or porosity, and is the preferred construct.

Figure 5:
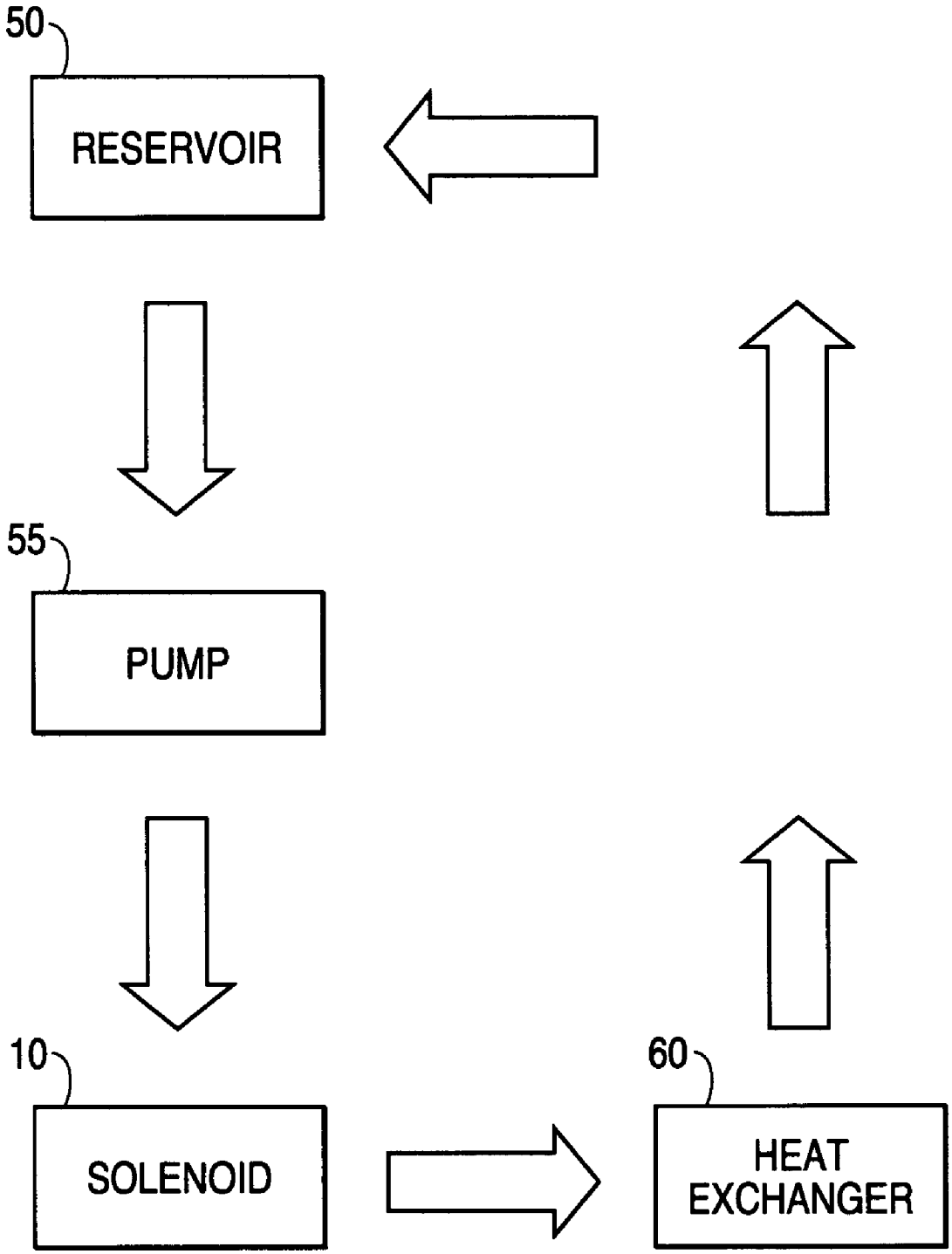
FIG. 5 is a block diagram of a cooling system for an electromagnetic solenoid coil.

The cooling system of solenoid 10 functions as follows. Coolant from a reservoir 50 is pumped by pump 55 through opening 30 into simulated pole piece 35. This flow is shown in flow diagram of FIG. 5. Virtually any coolant fluid may be used as long as it is non-conductive and non-corrosive. Examples of suitable coolants include water, ethylene glycol, and hydrocarbon fuels and oils. Coolants that are in the gas phase may also be used including argon, nitrogen, carbon dioxide and air. While gases such as chlorine and fluorine could be used, they are less preferred because of the corrosive byproducts that they can form. An advantage of a gas coolant is that at the normal operation temperature of a solenoid coil there will not be a phase change as there might be with a liquid coolant.

After entering simulated pole piece 35, the pressure applied to the system by pump 55 causes the coolant to move through coolant feed ports 27 and 28, through the perforated bobbin 20, and then bathe the duplex wound solenoid coil 25. The porosity of the coil winding provided by the duplex-twisted windings allows passage of large volumes of coolant. In particular, the porosity of the coil winding allows the coolant to travel radially from the inner core 15, through perforated bobbin 20, and to the outside diameter of the coil 25. The coolant limits the operating temperature rise of the coil wires 25 by removing heat from the warmer coil wires. Moreover, the through-coil coolant flows provide nearly independent control of input power and operating temperature which prevents coil overheat. After cascading over the wires 25, the coolant may be returned to reservoir 50. In an alternative embodiment, heat exchanger 60 cools the fluid on its way back to reservoir 50.

In the embodiment illustrated in FIG. 2 with both the supply manifold 65 and the receiver manifold 67, coolant enters the supply manifold 65, flows through the plenum 66 and into the inner core 15. From the inner core 15, the coolant flows through the perforated bobbin 20, through ports 28, and then through the wound coil wires 25 in a radial fashion. After bathing the coil wires 25, the coolant exits the wound wires 25 and enters the plenum 68 and the receiver manifold 67. The path of the coolant is illustrated by arrow 69 in FIG. 2.

In the embodiment illustrated in FIG. 3, the coolant enters through opening 30, into inner core 15, through ports 27 and 28, and then into and through the coil wire 25 as previously described in connection with the embodiment illustrated in FIG. 1. After exiting the coil wires 25, the coolant is collected in the plenum 68 and removed through the receiver manifold 67. For the embodiments with the supply manifold 65 and the receiver manifold 68, the manifolds prevent coolant from escaping from the cooling system.

While the invention has been described in its preferred embodiment, it is to be understood that the words used are words of description rather than limitation and that changes may be made within the purview of the appended claims without departing from the true scope and spirit of the invention in its broader aspects.

What is claimed is:

1. An electromagnetic solenoid coil comprising:

a simulated pole piece forming an inner core, said simulated pole piece further comprising coolant feed ports;

a perforated bobbin surrounding said simulated pole piece; and duplex wound solenoid coil wires;

wherein coolant is supplied to said simulated pole piece, said coolant traveling through said coolant feed ports, through said perforated bobbin, and through and around said duplex wound solenoid coil wires; and further wherein said duplex wound solenoid coil wires provide connected porosity that permits said coolant to flow radially from an inside diameter of said coil to an outside diameter of said coil.

2. The electromagnetic solenoid coil according to claim 1, wherein said perforations in said bobbin are cross-drilled.

3. The electromagnetic solenoid coil according to claim 1, wherein said solenoid coil wires comprise a winding of three or more wires.

4. The electromagnetic solenoid coil according to claim 1, wherein said coolant is a gas.

5. The electromagnetic solenoid coil according to claim 4, wherein said coolant is selected from the group consisting of chlorine and fluorine.

6. The electromagnetic solenoid coil according to claim 4, wherein said coolant is selected from the group consisting of argon, nitrogen, carbon dioxide and air.

7. The electromagnetic solenoid coil according to claim 1, wherein said coolant is a liquid.

8. The electromagnetic solenoid coil according to claim 7, wherein said coolant is selected from the group consisting of ethylene glycol, water and hydrocarbon fuels and oils.

9. An electromagnetic solenoid coil comprising:

a simulated pole piece forming an inner core, said simulated pole piece further comprising coolant feed ports;

a perforated bobbin surrounding said simulated pole piece; and two or more lengths of electromagnetic coil wire, said lengths wrapped around each other in a helical manner;

wherein coolant is supplied to said simulated pole piece, said coolant traveling through said coolant feed ports, through said perforated bobbin, and through and around said electromagnetic coil wire; and further wherein said electromagnetic coil wire provides connected porosity that permits said coolant to flow radially from an inside diameter of said coil to an outside diameter of said coil.

10. The electromagnetic solenoid coil according to claim 9, further comprising a supply manifold, said supply manifold supplying coolant to said electromagnetic coil wire.

11. The electromagnetic solenoid coil according to claim 10, further comprising a supply plenum, said supply plenum in communication with said supply manifold.

12. The electromagnetic solenoid coil according to claim 9, further comprising a receiver manifold, said receiver manifold positioned around said outside diameter of said coil, said receiver manifold receiving said coolant when said coolant exits said coil.

13. The electromagnetic solenoid coil according to claim 12, further comprising a receiver plenum, said receiver plenum in communication with said receiver manifold.

14. The electromagnetic solenoid according to claim 9, wherein said coolant is a liquid.

15. The electromagnetic solenoid according to claim 9, wherein said coolant is a gas.

16. An electromagnetic solenoid coil cooling system comprising:

a simulated pole piece forming an inner core, said simulated pole piece further comprising coolant feed ports;

a perforated bobbin surrounding said simulated pole piece;

duplex wound solenoid coil wires;

a reservoir to hold a coolant; and a pump;

wherein said pump removes coolant from said reservoir and supplies said coolant to said simulated pole piece, said coolant traveling through said coolant feed ports, through said perforated bobbin, and through and around said duplex wound solenoid coil wires; and further wherein said duplex wound solenoid coil wires provide connected porosity that permits said coolant to flow radially from an inside diameter of said coil to an outside diameter of said coil; and further wherein said coolant, upon exiting said coil, is routed to a heat exchanger, and upon exiting said heat exchanger, is routed back to said reservoir.

17. The electromagnetic solenoid coil cooling system according to claim 16, further comprising a supply manifold and a supply plenum, said supply manifold and said supply plenum supplying coolant to said inner core.

18. The electromagnetic solenoid coil cooling system according to claim 16, further comprising a receiver manifold and a receiver plenum, said receiver manifold and said receiver plenum surrounding said solenoid coil wires.

19. The electromagnetic solenoid according to claim 16, wherein said coolant is a liquid.

20. The electromagnetic solenoid according to claim 16, wherein said coolant is a gas.

* * * * *